US008118059B2

(12) United States Patent
Hoppe et al.

(10) Patent No.: US 8,118,059 B2
(45) Date of Patent: Feb. 21, 2012

(54) CONTROL VALVE FOR A CAMSHAFT ADJUSTER

(75) Inventors: Jens Hoppe, Erlangen (DE); Andreas Rohr, Heroldsbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 989 days.

(21) Appl. No.: 12/083,270

(22) PCT Filed: Sep. 7, 2006

(86) PCT No.: PCT/EP2006/066147

§ 371 (c)(1),
(2), (4) Date: Apr. 7, 2008

(87) PCT Pub. No.: WO2007/039399

PCT Pub. Date: Apr. 12, 2007

(65) Prior Publication Data

US 2009/0134349 A1 May 28, 2009

(30) Foreign Application Priority Data

Oct. 5, 2005 (DE) ..... 10 2005 047 641

(51) Int. Cl.
*F15B 13/044* (2006.01)
*F01L 1/34* (2006.01)

(52) U.S. Cl. ..... 137/625.68; 137/625.69; 251/368

(58) Field of Classification Search ..... 137/625.65, 137/625.68, 625.69; 251/368
See application file for complete search history.

(56) References Cited

U.S. PATENT DOCUMENTS

| | | | | | |
|---|---|---|---|---|---|
| 4,428,400 | A | * | 1/1984 | Tantardini | 137/625.68 |
| 4,488,574 | A | * | 12/1984 | Bartholomaus | 137/625.68 |
| 4,491,153 | A | * | 1/1985 | Bartholomaus | 137/625.65 |
| 4,611,631 | A | * | 9/1986 | Kosugi et al. | 137/625.65 |
| 6,289,921 | B1 | * | 9/2001 | Neuhaus et al. | 137/625.65 |
| 6,315,268 | B1 | * | 11/2001 | Cornea et al. | 137/625.68 |
| 6,527,249 | B2 | * | 3/2003 | Niimi et al. | 137/625.69 |
| 6,681,806 | B2 | * | 1/2004 | Isobe | 137/625.65 |
| 7,069,951 | B2 | * | 7/2006 | Cornea | 137/625.68 |
| 7,533,695 | B2 | * | 5/2009 | Strauss et al. | 137/625.68 |
| 7,841,361 | B2 | * | 11/2010 | Daut | 137/625.69 |
| 2005/0252561 | A1 | | 11/2005 | Strauss et al. | |

FOREIGN PATENT DOCUMENTS

| | | | |
|---|---|---|---|
| DE | 19853670 | | 5/2000 |
| DE | 10239207 | | 3/2004 |
| DE | 102004002192 | | 8/2005 |
| DE | 102004038160 | | 12/2005 |
| DE | 102004038252 | | 12/2005 |
| DE | 102005037480 | | 2/2007 |
| JP | 06033710 | | 2/1994 |
| JP | 11002354 | | 1/1999 |
| WO | WO 2006079382 | * | 8/2006 |

* cited by examiner

*Primary Examiner* — John Rivell
(74) *Attorney, Agent, or Firm* — Volpe and Koenig, P.C.

(57) ABSTRACT

A control valve for a hydraulic adjuster for the camshaft of an internal combustion engine is provided, wherein an actuator acts on a pressure part (12) embedded in a control piston (5). In order to prevent the piston (5) from being blocked in the valve housing by the expansion thereof caused by the pressure part embedment, the pressure part (12) and/or the control piston (5) is/are provided with radial recesses (34) in the embedment area (13) which make it possible to limit joining forces and the resulting radial expansion of the piston (5). Alternatively or in addition, the external surface of the control valve (5) has a reduced cross-section in the embedment area (13).

9 Claims, 4 Drawing Sheets

CONTROL VALVE FOR A CAMSHAFT ADJUSTER

BACKGROUND

The invention relates to a control valve for influencing the pressurization of a camshaft adjuster of an internal combustion engine with pressurized medium according to the preamble of Claim 1 and Claim 3. The invention further relates to a control valve according to the preamble of Claim 6.

From the non-published patent applications DE 10 2004 038 160.7 and also DE 10 2005 037 480.8 by the applicant, a control valve for influencing the pressurization of a camshaft adjuster of an internal combustion engine with pressurized medium is known, in which a control piston can move axially in a pocket borehole of a valve housing. The control valve has a pressurized medium connection, two tank connections, and two work connections, which are allocated to working chambers acting against each other in a hydraulic camshaft adjuster. In one axial position of the control piston in the control valve, a first working connection is connected to a tank connection and a second working connection is connected to the pressurized medium connection, so that an adjustment movement of the camshaft adjuster can be brought about, in which the working chamber allocated to the second working connection increases its volume. In another axial position of the control piston, the second working connection is connected to a tank connection and the first working connection is connected to the pressurized medium connection, so that an opposite adjustment movement can be brought about, in which the working chamber allocated to the first working connection increases its volume. For changing the axial position of the control piston, this has a pressure part, on which an actuator acts for bringing about a displacement of the control piston. From production reasons, the pressure part is formed separate from the control piston and embedded in the valve housing with an outer casing surface in the region of an inner casing surface of an end-face recess of the valve housing.

SUMMARY

The invention is based on the object of providing a control valve with an improved integrated pressure part.

According to the invention, the objective of the invention is met by the features of the independent Claim 1. An alternative solution to meeting the objective forming the basis of the invention is given by the features of Claim 3. The solution forming the basis of the invention is further provided by the features of Claim 6. Additional constructions of the invention emerge from the dependent Claims 2, 4, 5, and 7 to 9.

The present invention is based on the knowledge that, for a positive-fit and/or friction-fit connection of a pressure part to a control piston, radially oriented contact forces are generated between the pressure part and the control piston, wherein these contact forces involve a radially elastic and/or plastic deformation of the pressure part and/or the control piston and are generated while being embedded, for example, with an over-dimensioning of the outer casing surface of the pressure part relative to the inner casing surface of the control piston, especially with simultaneous heating. The control piston moves in a guide borehole formed by a pocket borehole of the valve housing. For guaranteeing

- the effect of control edges of the control piston,
- good fixing of the control piston in the valve housing, and
- easy movement of the control piston without the control piston seizing in the valve housing, it is necessary that the diameters of the outer casing surface of the control piston and the guide borehole of the valve housing be constructed with a fit. With respect to the setting of the diameter

- of the outer casing surface of the pressure part,
- of the inner casing surface of the control piston, and
- of the outer casing surface of the control piston, the geometries of the previously mentioned components as well as the embedding processes are to be optimized, which leads, under some circumstances, to a conflict in objectives:

- on one hand, a fixed connection of the pressure part shall be achieved with the control piston, which requires rather large contact forces between the pressure part and control piston.
- on the other hand, a small expansion of the outer casing surface should be given due to the embedding, which requires rather small contact forces between the pressure part and control piston.

The above optimization can be made more difficult under some circumstances in such a way that a requirement on a given, tight fit range between the control piston and valve housing requires, for given material properties of the pressure part and control piston, especially for given stiffness, a tight tolerance for the production of the diameter of the outer casing surface of the pressure part and also the inner casing surface of the control piston.

As an aid, the invention proposes that at least one casing surface of the pressure part and/or the control piston forming a contact face has a partial region, which has a reduced stiffness relative to deformation in the radial direction than another partial region of the casing surface, in the contact area between the pressure part and the control piston. This possibly leads to the following advantages:

- The partial regions with reduced stiffness can reduce the stiffness in partial regions of the periphery, by which tolerance-dependent deviations in the production of the involved contact geometries lead to a smaller change of the generated contact forces. In this way, the connection produced by the embedding process between the pressure part and the control piston becomes less dependent on the production tolerances.
- On the other hand, this construction of the invention is based on the knowledge that for a contact between two cylindrical casing surfaces, the contact force is not distributed constantly over the entire periphery. According to the invention, targeted smaller contact surfaces can be given in the partial regions of reduced stiffness, while in the other partial regions, targeted contact regions of greater contact forces can be provided.
- Furthermore, by setting the dimensions of the partial regions of the reduced stiffness as well as the selection of the stiffness, for example, by the material selection in the partial regions, the necessary joining force is structurally provided for embedding the pressure part into the control piston.
- Through the use of partial regions of reduced stiffness, the radial forces in the contact region between the pressure part and control piston can be reduced, indeed, also for the selection of a relatively stiff base material for the pressure part and/or control piston. This leads, under some circumstances, to a reduced expansion of the control piston in the embedding region.

The partial regions with reduced stiffness can be constructed with a softer, more pliable material than the partial regions of the other partial regions. According to a preferred construction of the invention, the partial regions with reduced stiffness are formed with radial recesses. Such radial recesses can involve, for example, radial boreholes or grooves running in the axial direction or spiral grooves. The recesses thus form partial regions with zero stiffness, so that contact forces between the outer casing surface of the control piston and the inner guide surface of the valve housing are formed only in the partial regions lying apart from the recesses.

The recesses can be formed radially outwardly in the control piston or else radially inwardly in the outer casing surface of the pressure part, wherein the recesses can be formed immediately during production or at a later time, for example, by a cutting production method, such as milling or boring. For the case that recesses are formed both in the control piston and also in the pressure part, these can transition into each other in the radial direction or else can be offset relative to each other in the radial and/or axial direction.

Through a structural setting of the extent B of the recesses in the peripheral direction, in a simple way the magnitude of the joining forces can be set. It is also conceivable that the extent of the recesses in the peripheral direction varies in the axial direction, by which a variation of the contact forces and the elastic expansion of the control piston in the axial direction or, for example, an increase of the joining force with increasing insertion of the pressure part into the control piston can be set.

Preferably, the radial recesses have a multifunctional construction: in addition to the setting of the joining and pressing forces, the radial recesses can be used, in particular, for the case that these are formed continuous over the entire length of the pressure part or start from the end side of the pressure part, as channels, which connect an inner space or pressure space of the control piston with the outside of the control piston, in particular, with the end face allocated to the pressure part. For example, the inner space of the piston can be vented via the recesses. Alternatively or cumulatively, it is possible that the pressurized medium arranged in the interior is discharged through the channels formed with the radial recesses in the region of the end side of the control piston. For example, in the region of the end side, an electromagnetic actuator can be provided with a magnetic pin and suitable mounting, as well as an armature interior. In this case, the pressurized medium communicates via the radial recesses with the actuator, in particular, the armature interior, for exchanging the pressurized medium for lubrication purposes and for heat dissipation. Furthermore, such a pressurized medium flow is used for lubricating a magnetic mounting and/or for reducing the friction between the pressure part and the magnetic pin acting on the pressure part.

The interior of the control piston can be vented in this case in such a way that the pressurized medium passing through the recesses is fed from the interior of the control piston into an unpressurized intermediate space between the actuator and the pressure part and can flow from there into a motor sump. Through rotation of the control valve during operation, air in the pressurized medium can be separated and can also be discharged via the radial recesses.

Another alternative or cumulative solution according to the invention provides play in the embedding region of the pressure part between an outer casing surface of the control piston and a guide borehole of the valve housing. This construction of the invention takes into account the fact that the embedding the pressure part causes a more or less large radial increase in the allocated embedding region of the control piston, so that in each case the fit between the control piston and the valve housing is changed. This is especially disadvantageous when the outer casing surface of the control piston in the embedding region of the pressure part forms a guide surface, which contacts the guide borehole of the valve housing during the axial movement of the control piston and, under some circumstances, should also fulfill a sealing function. According to the invention, this guide surface is displaced away from the embedding region of the pressure part. Instead, in the embedding region of the pressure part between the control piston and the valve housing, there is play, so that the control piston does not come into contact with the guide borehole of the valve housing in the embedding region even for radial expansion of the control piston due to the embedding of the pressure part. In this way, seizing of the control piston in the guide borehole can be reliably prevented, under some circumstances, also independent of any tolerances in the production of the pressure part and/or control piston and/or guide borehole.

For the case that the guide borehole is constructed as a continuous pocket borehole with constant diameter, especially in the axial region covered by the embedding region in the course of the axial movement, the play named above can be easily generated in such a way that the outer casing surface of the control piston has a region of reduced diameter, which transitions, for example, over a cross-sectional extension into a guide surface, in the embedding region of the pressure part.

An alternative or cumulative solution of the problem forming the basis of the invention is given by the features of Claim 6. Accordingly, the pressure part has a hardened surface at least in the region of an end face facing the actuator. For such a construction, it is not necessary, in particular, that the entire control piston is subjected to a hardening process, which takes into account the bonding or the contact between the actuator and the pressure part. For the case that such hardening is performed for the entire control valve, this could lead to warping of the control piston, which could also have disadvantageous effects on the formation of the contact surfaces between the pressure part and the control piston on one hand and also the control piston and the valve housing on the other hand. Instead, according to the invention the pressure part could be hardened separately from the control piston. Hardening could also be performed taking advantage of the residual carbon content of the pressure part, in that the pressure parts are inserted into a hardening bath. For example, pressure parts for several control valves could also be inserted together in one hardening bath.

According to another construction of the invention, the surface is hardened in the contact region between the pressure part and the actuator by a deep-drawing process. The use of a deep-drawing process is preferred especially for an approximately pot-shaped construction of the pressure part with a U-shaped longitudinal section of the pressure part.

An increase in the production accuracy can be achieved advantageously in such a way that a calibration stage is then used at a deep-drawing processing step, for which the pressure part is then pressed into a mold in the deep-drawing processing step, in which the final dimensions of the pressure part are at least approximated.

Alternatively or additionally, the hardened surface can be hardened under the use of a heat treatment.

Advantageous refinements of the invention emerge from the claims, the description, and the drawings. The advantages named in the introduction of the description for features and combinations of several features are merely examples and these do not absolutely have to be achieved by embodiments according to the invention. Additional features are to be taken from the drawings in particular, the illustrated geometries and the relative dimensions of several components relative to each other and also their relative arrangement and active connection. The combination of features of different embodiments of the invention or of features of different claims is also possible deviating from the selected references of the claims and is herewith suggested. This also relates to those features, which are shown in separate drawings or which are named in their description. These features can also be combined with features of different claims. Likewise, features listed in the claims can be left out for other embodiments of the invention.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

Figure 1:
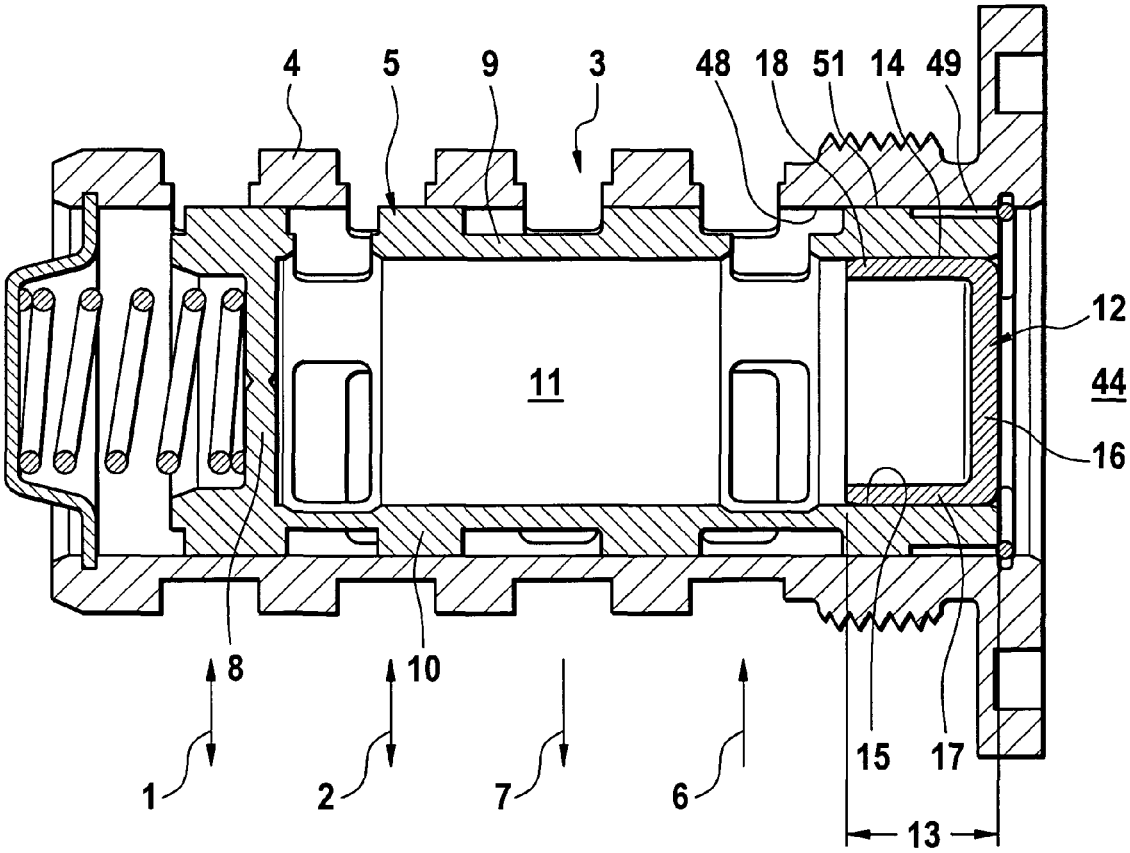
FIG. 1 is a longitudinal section view of a control valve for controlling a hydraulic camshaft adjuster with a pressure part embedded in the control piston and a valve housing.

A camshaft adjuster, as described in the not previously published state of the art named above, for example, typically has a stator and a rotor, wherein a drive wheel is locked in rotation with the stator. The stator is mounted rotatable relative to the rotor, wherein the stator has several recesses spaced apart from each other in the peripheral direction. The recesses are separated by vanes extending radially from the rotor into two pressure chambers, wherein a change in the pressure relationships in opposing pressure chambers is associated with an adjustment movement of the camshaft adjuster.

The pressure chambers are each connected via suitable supply lines to a working connection 1, 2 of a control valve 3. The control valve 3 has a control piston 5 that can move axially in a valve housing 4. For generating an adjustment movement of the camshaft adjuster, the working connections 1, 2 can be connected to a pressurized medium connection 6 or a tank connection 7 according to the axial position of the control piston 5 in the valve housing 4. The control valve 3 is preferably integrated in a central, axial recess of the rotor of the camshaft adjuster.

With respect to other constructions of the control valve as well as their integration into a camshaft adjuster, refer to the not previously published patent applications by the applicant noted above.

According to FIG. 1, the control piston 5 has an approximately U-shaped construction in the longitudinal section with a base leg 8 and two side legs 9, 10. Inside of the control piston 5 an interior 11 is formed, which is limited by the legs 8, 9, 10 and also a pressure part 12 embedded between the side legs 9, 10 opposite the base leg. The pressure part 12 is embedded in an embedding region 13 through the formation of a radial contact force in the control piston 5. In the embedding region 13, the pressure part 12 has an outer, cylindrical casing surface 14 and the control piston 5 has an inner, cylindrical casing surface 15, wherein the casing surfaces 14, 15 form an interference fit.

The pressure part 12 has a U-shaped longitudinal section with a base leg 16 and two side legs 17, 18. The U-shaped longitudinal sections of the control piston 5 and the pressure part 12 are inserted one inside the other with an opposite orientation sense. The length of the side legs 17, 18 corresponds to the extent of the embedding region 13 in the axial direction.

Figure 2:
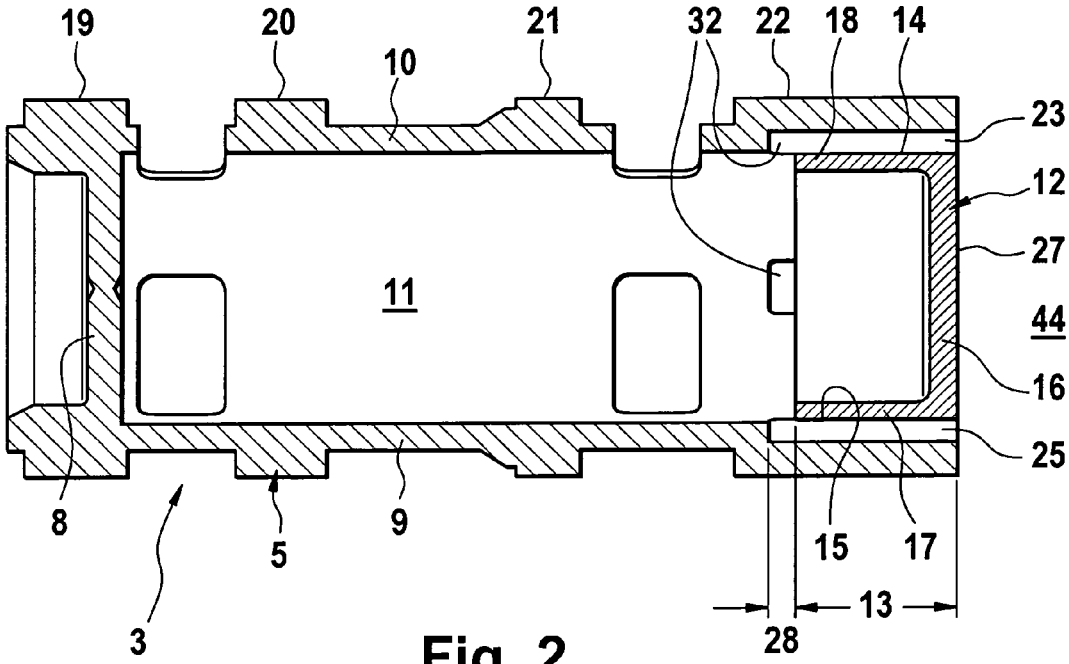
FIG. 2 is a longitudinal section view of a first construction according to the invention of a connection of a pressure part with a control piston.

According to FIG. 2, the control piston 5 has coaxial guide surfaces 19, 20, 21, 22, which are spaced apart from each other axially, wherein the guide surface 22 allocated closest to the end side 27 of the control piston 5 allocated to the pressure part 12 extends in the embedding region 13 and projects past this region according to FIG. 2.

Figure 3:
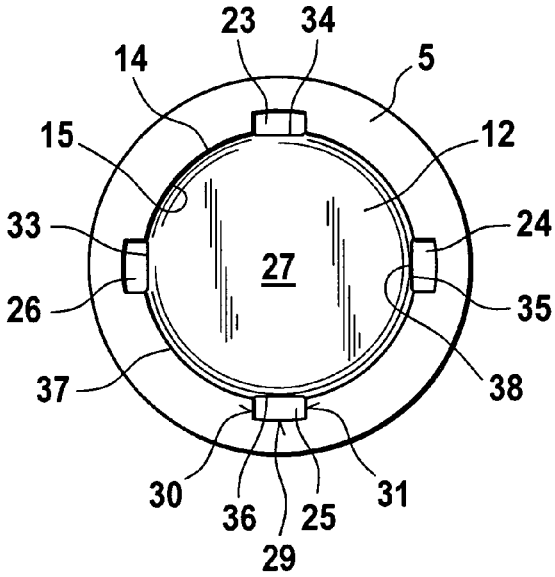
FIG. 3 is a view of the connection of the pressure part with the control piston according to FIG. 2 for taken in a direction from an actuator of the control valve.

According to FIG. 3, the control piston 5 provides recesses 23, 24, 25, 26 oriented radially outwards and distributed uniformly in the peripheral direction. The recesses 23 to 26 extend like grooves starting from the end side 27 over the entire embedding region 13 with a projection 28 past the pressure part 12 in the axial direction. The recesses 23 to 26 have an approximately U-shaped construction in the cross section shown in FIG. 3 with a groove base 29 as well as two parallel borders 30, 31 oriented approximately radially. In the region of the projection 28, the recesses 23 to 26 form openings 32, which create a pressurized medium connection between the interior 11 and the recesses 23-26. The pressure part 12 can have a cylindrical, outer casing surface 14 without a recess. For the embodiment shown in FIG. 3, it can be seen that the pressure part 12 also has recesses 33, 34, 35, 36 oriented radially inwardly, which extend in the area of the recesses 23 to 26, by which channels are formed with approximately rectangular cross section. With the embedding of the pressure part 12 in the control piston 5,

- partial regions 37 are given, which contact the casing surface 14 of the pressure part 12 under formation of a contact force at the casing surface 15 of the control piston 5, and also
- partial regions 38 are given, which are arranged in the peripheral direction between the partial regions 37 and in the region of which the pressure part 12 and the control piston 5 do not contact each other in the radial direction, but instead in which the pressure part 12 and control piston 5 have channels.

Figure 4:
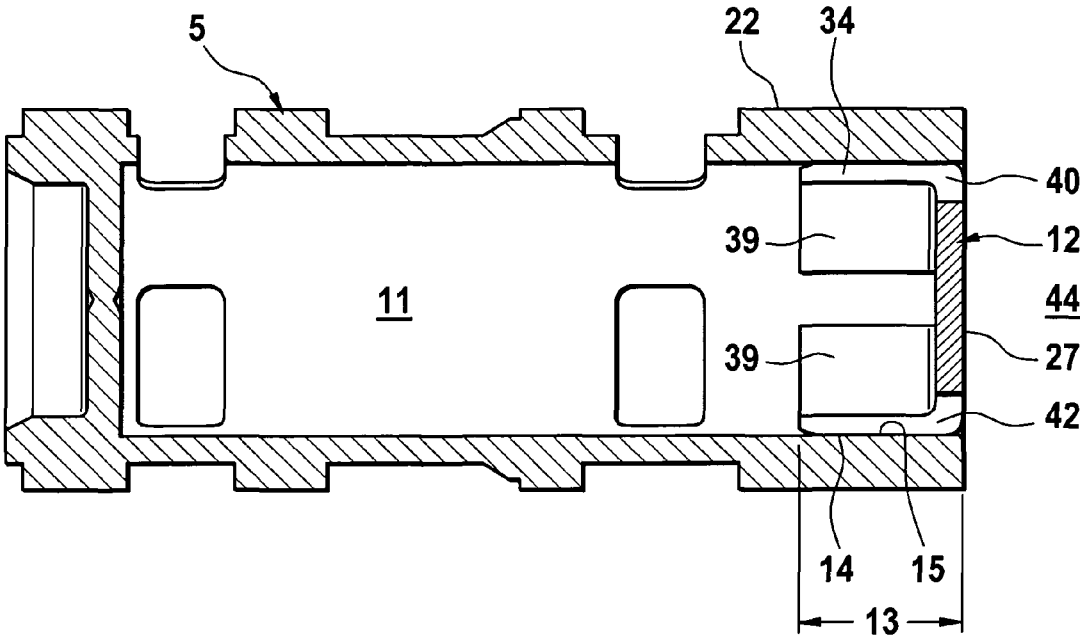
FIG. 4 is a longitudinal section view of a second construction according to the invention of a connection of a pressure part with a control piston.
Figure 5:
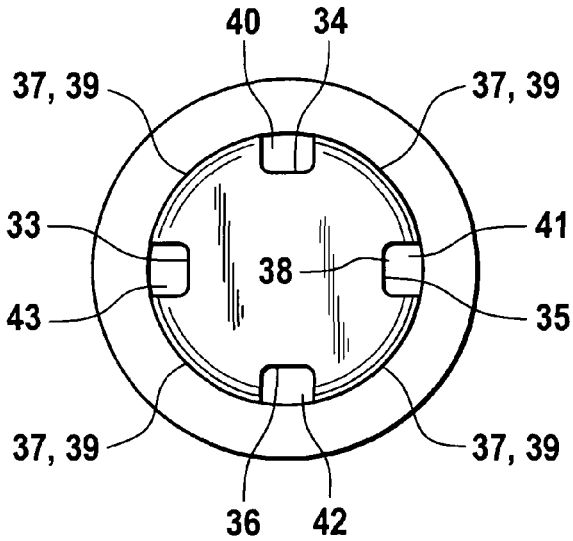
FIG. 5 is a view of the connection between the pressure part and control piston according to FIG. 4 taken from an actuator of the control valve.

For the embodiment shown in FIGS. 4 and 5, the control piston 5 has no recesses 23 to 26. The recesses 33 to 36 of the pressure part 12 are constructed with a depth that is increased relative to the embodiment according to FIGS. 2 and 3 in such a way that these extend completely through the side legs 17, 18, so that the pressure part 12 is not circular in the region of the side legs 17, 18, but instead provided merely with "fingers" 39 extending between the recesses 36 to 33 into the partial regions 37. Due to the increased depth of the recesses 33 to 36, the recesses 33 to 36 form, in the region of the end side 27, openings 40, 41, 42, 43, in the region of which a direct pressurized medium connection is given between the interior 11 and the surrounding 44 of the end side 27 of the control piston 5.

The surrounding 44 involves, in particular, a contact surface between the pressure part and an actuator not shown in the figures, under some circumstances with a pressurized medium connection with a motor sump and/or additional components, lubricating positions, or cooling positions of the actuator.

Figure 6:
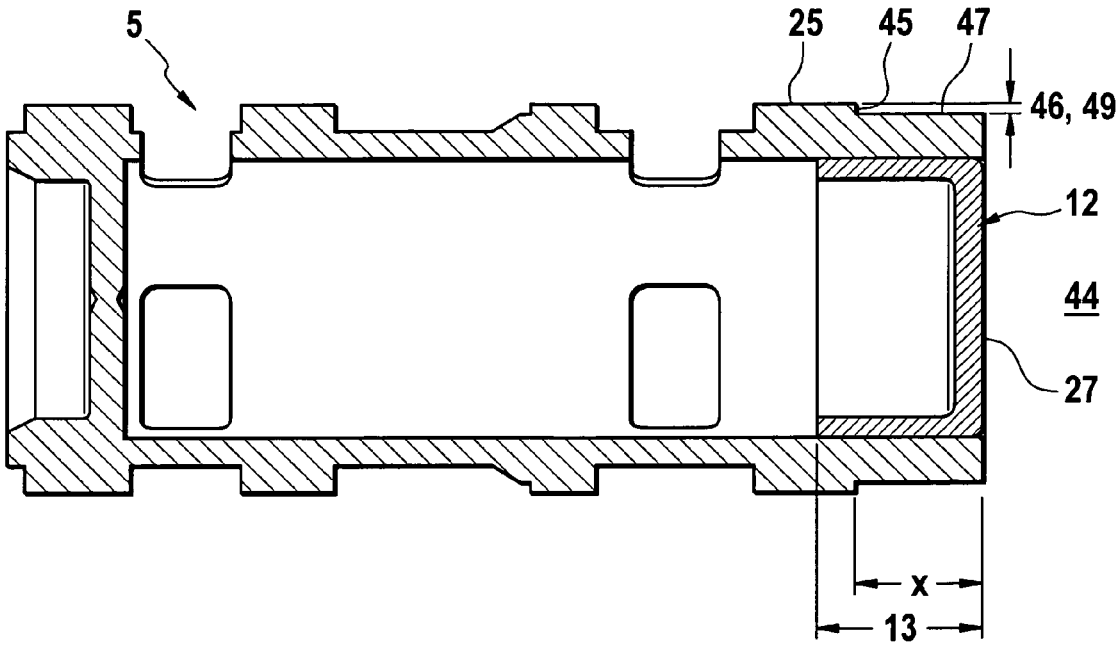
FIG. 6 is a longitudinal section view of another construction according to the invention of a control piston with pressure part embedded in this piston.
Figure 7:
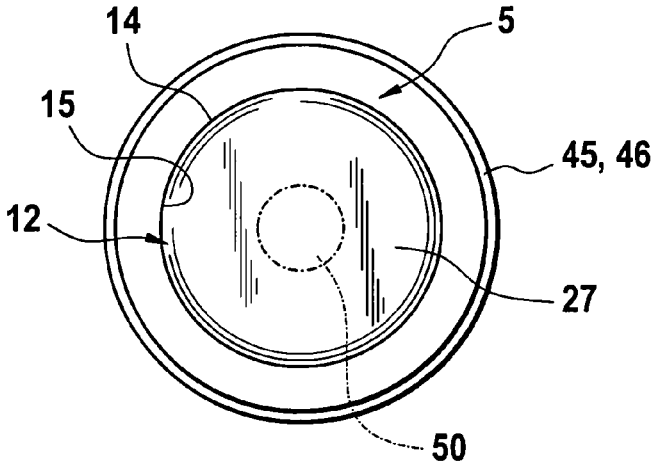
FIG. 7 is a view of the control piston with pressure part embedded in this piston from a direction of an actuator of the control valve.

For the embodiment shown in FIGS. 6 and 7, the outer casing surface of the control piston 5 in the region of the end side 27 allocated to the pressure part 12 has a partial region 47 with cylindrical casing surface, which is advanced relative to the guide surface 22 with a shoulder 45 with a cross-sectional reduction 46 in the direction of the end side 27. For the control piston 5 inserted into the valve housing, a radially surrounding gap 49, whose size corresponds to the cross-sectional reduction 46, is formed between an inner casing surface 48 of the valve housing 4 and the partial region 47. In the partial region 47, to prevent a contact between the control piston 5 and valve housing 4, the cross-sectional reduction 46 is suitable structurally, in order to take into account the expected expansion of the control piston 5 due to the embedding of the pressure part 12. This means, e.g., that for an increase of the setting of the covering of the press connection, the cross-sectional reduction 46 must have an increased construction.

The length x of the partial region 47 is to be adapted to the region, in which a cross-sectional expansion of the control piston 5 is expected due to the embedding of the pressure part 12. For the embodiment shown in FIGS. 6 and 7, x is smaller than the embedding region 13, so that the embedding region 13 extends approximately up to the middle of the guide region 22.

The end side 27 of the pressure part 12 has a contact surface 50, in the region of which an actuator, especially a magnetic pin or a tappet of the actuator, acts on the pressure part 12, in order to move the control piston 5 axially in the valve housing 4. For preventing wear of the pressure part 12 in the region of the contact surface 50, the contact surface 50, the end side 27 of the pressure part 12, or the surface of the entire pressure part 12 can be hardened.

Such hardening can be performed, on one hand, by deep-drawing production with a subsequent calibration stage and, on the other hand, by a corresponding heat treatment of the pressure part 12. Such hardening is thus realized only for the pressure part 12, by which a separate treatment of the entire control piston 5 is prevented for guaranteeing a fatigue endurable contact surface.

Through the use of the recesses 23 to 26 and also 33 to 36, the interior 11 can be vented and/or sufficient leakage volume flow for supplying a mounting of an actuator, for example, a mounting of a magnet, with pressurized medium can be guaranteed.

The recesses 23 to 26 and 33 to 36 represent a partial reduction of the joint diameter, by which the contact and pressing forces can be influenced. As a whole, through the measures according to the invention, the production of the control piston 5 with the pressure part 12 can be simplified. The width B of the recesses 23 to 26 and 33 to 36, that is, in particular, the width of the groove base 29, can be suitable structurally and varied, in order to influence the magnitude of the necessary joining forces and the retaining forces in the connection. The goal in the setting of the width B is to avoid an expansion of the control piston 5 in the embedding region 13, in order to avoid seizing of the control piston 5 in the valve housing 4.

In the embedding region 13, the control piston 15 has an outer casing surface 51.

LIST OF REFERENCE SYMBOLS

1 Working connection
2 Working connection
3 Control valve
4 Valve housing
5 Control piston
6 Pressurized medium connection
7 Tank connection
8 Base leg
9, 10 Side leg
11 Interior
12 Pressure part
13 Embedding region
14, 15 Casing surface
16 Base leg
17, 18 Side leg
19-22 Guide surface
23-26 Recess
27 End side
28 Projection
29 Base groove
30, 31 Boundary
32 Opening
33-36 Recess
37, 38 Partial region
39 Finger
40-43 Opening
44 Surrounding
45 Shoulder
46 Cross-sectional reduction
47 Partial region
48 Casing surface
49 Gap
50 Contact surface
51 Casing surface

The invention claimed is:

1. Control valve for influencing pressurization of a camshaft actuator of an internal combustion engine with pressurized medium, the control valve comprising: a) a valve housing and b) a control piston, which is arranged in the valve housing and which can be displaced axially, wherein c) pressurization of a pressurized medium connection, a tank connection, and at least one work connection with pressurized medium can be changed as a function of an axial position of the control piston and d) the control piston has a pressure part, da) which is embedded in an embedding region with an outer casing surface into an inner casing surface of an end-side recess of the valve housing in the valve housing and db) on which an actuator for generating a displacement of the control piston acts, e) at least one of the outer or inner casing surface has at least one partial region, which has a smaller stiffness and is less resistant to deformation in a radial direction than another partial region.

2. Control valve according to claim 1, wherein the at least one partial region with reduced stiffness is formed with radial recesses.

3. Control valve for influencing the pressurization of a camshaft actuator of an internal combustion engine with pressurized medium, the control valve comprising: a) a valve housing and b) a control piston, which is arranged in the valve housing and which can be displaced axially, wherein c) pressurization of a pressurized medium connection, a tank connection, and at least one work connection with pressurized medium can be changed as a function of an axial position of the control piston and d) the control piston has a pressure part, da) which is embedded in an embedding region with an outer casing surface into an inner casing surface of an end-side recess of the valve housing in the valve housing and db) on which an actuator for generating a displacement of the control piston (5) acts, and e) in an embedding region of the pressure part, a gap is provided between an outer casing surface of the control piston and a guide borehole of the valve housing.

4. Control valve according to claim 3, wherein in the embedding region of the pressure part, the outer casing surface of the control piston has a partial region of reduced diameter.

5. Control valve according to claim 4, wherein a guide surface of the control piston connects to the partial region of reduced diameter.

6. Control valve for influencing the pressurization of a camshaft actuator of an internal combustion engine with pressurized medium, the control valve comprising: a) a valve housing, b) a control piston, which is arranged in the valve housing and which can be displaced axially, wherein c) pressurization of a pressurized medium connection, a tank connection, and at least one work connection with pressurized medium can be changed as a function of an axial position of the control piston and d) the control piston has a pressure part, on which an actuator for generating a displacement of the control piston acts, and e) the pressure part has a hardened surface at least in a region of a contact surface interacting with the actuator, wherein the hardened surface has a smaller diameter than a base end of the pressure part.

7. Control valve according to claim 6, wherein the hardened surface is hardened by deep drawing.

8. Control valve according to claim 7, wherein the pressure part is calibrated after the hardened surface is hardened.

9. Control valve according to claim 6, wherein the hardened surface is heat treated for hardening.

* * * * *